US012408718B2

(12) United States Patent
Teetzel et al.

(10) Patent No.: US 12,408,718 B2
(45) Date of Patent: Sep. 9, 2025

(54) POWERED HELMET ACCESSORY RAIL WITH SLOT INTERFACE

(71) Applicant: WILCOX INDUSTRIES CORP., Newington, NH (US)

(72) Inventors: James W. Teetzel, Portsmouth, NH (US); Elliott S. Turner, Newmarket, NH (US)

(73) Assignee: Wilcox Industries Corp., Newington, NH (US)

( * ) Notice: Subject to any disclaimer, the term of this patent is extended or adjusted under 35 U.S.C. 154(b) by 0 days.

(21) Appl. No.: 18/760,275

(22) Filed: Jul. 1, 2024

(65) Prior Publication Data

US 2025/0009063 A1 Jan. 9, 2025

Related U.S. Application Data

(60) Provisional application No. 63/525,620, filed on Jul. 7, 2023.

(51) Int. Cl.
*A42B 3/04* (2006.01)

(52) U.S. Cl.
CPC ..... *A42B 3/0406* (2013.01)

(58) Field of Classification Search
CPC ..... A42B 3/0406; A42B 3/30; A42B 3/04; A42B 3/044

(Continued)

(56) References Cited

U.S. PATENT DOCUMENTS 5,683,831 A 11/1997 Baril et al.
7,219,370 B1 5/2007 Teetzel et al.

(Continued)

FOREIGN PATENT DOCUMENTS

CN 201468108 U 5/2010
EP 3714721 A1 9/2020

(Continued)

OTHER PUBLICATIONS

International Search Report and Written Opinion in Application No. PCT/US2024/027798 dated Jul. 26, 2024, 8 pages.

(Continued)

*Primary Examiner* — Timothy K Trieu
(74) *Attorney, Agent, or Firm* — McLane Middleton, Professional Association

(57) ABSTRACT

A rail interface system for connecting a helmet accessory component to a helmet comprises an interface body configured for attachment to an exterior surface of a helmet. The interface body is configured for attachment of the helmet accessory component. A slotted interface portion on the interface body has opposing first and second surfaces. At least one elongated rail opening extends through the slotted interface portion and is configured to receive a retention clip on the helmet accessory device for detachably securing the helmet accessory device to the rail interface system. At least one electrical connector is positioned adjacent a respective one of the at least one elongated rail opening. The at least one electrical connector is operational to provide one or both of electrical power and data communication to the helmet accessory component when the helmet accessory component is attached to the rail interface system.

10 Claims, 11 Drawing Sheets

(58) Field of Classification Search
USPC ..... 2/422; 224/181
See application file for complete search history.

(56) References Cited

U.S. PATENT DOCUMENTS

| | | | | |
|---|---|---|---|---|
| 8,531,592 | B2 | 9/2013 | Teetzel et al. | |
| 8,826,463 | B2 | 9/2014 | Teetzel et al. | |
| 8,984,665 | B2 | 3/2015 | Celona et al. | |
| 9,113,129 | B2 | 8/2015 | Teetzel et al. | |
| 10,557,687 | B2 | 2/2020 | Teetzel et al. | |
| 10,886,646 | B2 | 1/2021 | Goupil et al. | |
| 10,928,163 | B2 | 2/2021 | Zimmer | |
| 11,330,857 | B2 | 5/2022 | Teetzel et al. | |
| 11,360,309 | B2 | 6/2022 | Goupil et al. | |
| 11,419,382 | B2 | 8/2022 | Teetzel et al. | |
| 11,452,328 | B2 | 9/2022 | Franzino et al. | |
| 11,612,207 | B2 | 3/2023 | Teetzel et al. | |
| 11,758,962 | B2 * | 9/2023 | Havola ..... | A42B 3/0406 2/422 |
| 12,285,069 | B2 | 4/2025 | Teetzel et al. | |
| 2010/0031552 | A1 | 2/2010 | Houde-Walter | |
| 2014/0270800 | A1 | 9/2014 | Masarik | |
| 2017/0205202 | A1 | 7/2017 | Teetzel et al. | |
| 2019/0101359 | A1 | 4/2019 | Zimmer | |
| 2019/0104797 | A1 | 4/2019 | Teetzel et al. | |
| 2019/0208854 | A1 | 7/2019 | Teetzel et al. | |
| 2019/0386412 | A1 | 12/2019 | Goupil et al. | |
| 2020/0077732 | A1 * | 3/2020 | O'Connell ..... | A42B 3/0406 |
| 2020/0225488 | A1 | 7/2020 | Goupil et al. | |
| 2021/0315314 | A1 | 10/2021 | Teetzel et al. | |
| 2022/0071336 | A1 * | 3/2022 | Franzino ..... | A42B 3/0433 |
| 2022/0408869 | A1 | 12/2022 | Franzino et al. | |
| 2023/0046229 | A1 | 2/2023 | Moore | |
| 2024/0035779 | A1 | 2/2024 | Teetzel et al. | |
| 2024/0080647 | A1 | 3/2024 | Musa et al. | |
| 2024/0164464 | A1 | 5/2024 | Teetzel et al. | |
| 2024/0204328 | A1 | 6/2024 | Teetzel et al. | |
| 2024/0255257 | A1 | 8/2024 | Teetzel et al. | |
| 2024/0315372 | A1 | 9/2024 | Teetzel et al. | |
| 2024/0349837 | A1 | 10/2024 | Teetzel | |
| 2024/0356143 | A1 | 10/2024 | Teetzel et al. | |
| 2024/0377872 | A1 | 11/2024 | Teetzel et al. | |

FOREIGN PATENT DOCUMENTS

| | | | |
|---|---|---|---|
| EP | 4437894 | A1 | 10/2024 |
| EP | 4467031 | A1 | 11/2024 |
| WO | 2020237189 | A1 | 11/2020 |
| WO | 2022115531 | A1 | 6/2022 |

OTHER PUBLICATIONS

Extended European Search Report for European Application No. 24186740.7 dated Dec. 5, 2024, 8 pages.

English machine translation of Chinese Utility Model No. CN 201468108 U to Yang, entitled "Sport Helmet with Digital Camera," published May 19, 2010; translation obtained from Espacenet.

* cited by examiner

POWERED HELMET ACCESSORY RAIL WITH SLOT INTERFACE

CROSS REFERENCE TO RELATED APPLICATION

This application claims the priority benefit of U.S. provisional application No. 63/525,620 filed Jul. 7, 2023. The aforementioned application is incorporated herein by reference in its entirety.

BACKGROUND

The present invention relates to helmet mounts and, in particular, to helmet mounted accessory rail with power and data connection.

Advantages and benefits of the present invention will become apparent to those of ordinary skill in the art upon reading and understanding the following detailed description of the preferred embodiments.

SUMMARY

In one aspect, a rail interface system is provided for connecting a helmet accessory component to a helmet. The rail interface system comprises an interface body configured for attachment to an exterior surface of a helmet. The interface body is also configured for attachment of the helmet accessory component thereto. A slotted interface portion on the interface body has a first surface and a second surface opposite the first surface. At least one elongated rail opening extends through the slotted interface portion and is configured to receive a retention clip on the helmet accessory device for detachably securing the helmet accessory device to the rail interface system. At least one electrical connector is positioned adjacent a respective one of the at least one elongated rail opening, the at least one electrical connector being operational to provide one or both of electrical power and data communication to the helmet accessory component when the helmet accessory component is attached to the rail interface system.

In a more limited aspect, the least one elongated rail opening is bounded by an inward flange and the retention clip is a rotatable, generally T-shaped retention clip configured to pass through the at least one elongated rail opening when the generally T-shaped retention clip is rotated to an unlocked orientation parallel to a longitudinal axis of the at least one elongated rail opening. The at least one elongated rail opening is configured for clamping engagement of the inward flange when the generally T-shaped retention clip is rotated to a locked orientation perpendicular to the longitudinal axis of the at least one elongated rail opening.

In another more limited aspect, the at least one elongated rail opening conforms to an M-LOK™ rail standard.

In another more limited aspect, the slotted interface portion includes a plurality of elongated rail openings and a plurality of electrical connectors.

In another more limited aspect, the at least one electrical connector is a USB-C receptacle connector which is arranged to align with a USB-C plug on the helmet accessory component.

In another more limited aspect, the rail interface system herein is provided in combination with the helmet accessory component.

In another more limited aspect, the helmet accessory component is selected from the group consisting of circumaural devices, headphones, communications headsets, hearing protection devices, flashlights, tactical lights, cameras, and video recording devices.

In another more limited aspect, the at least one electrical connector is operably coupled to a circuit board disposed within the interface body.

In another more limited aspect, the rail interface system comprises a multiconductor cable electrically coupled to the circuit board, the multiconductor cable disposed on an inward facing side of the interface body.

In another more limited aspect, the multiconductor cable is configured to electrically couple the helmet accessory component to an external power source.

In another more limited aspect, the rail interface system further comprises a battery adapter configured to detachably receive and electrically couple to one or more battery packs.

Advantages and benefits of the present development will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
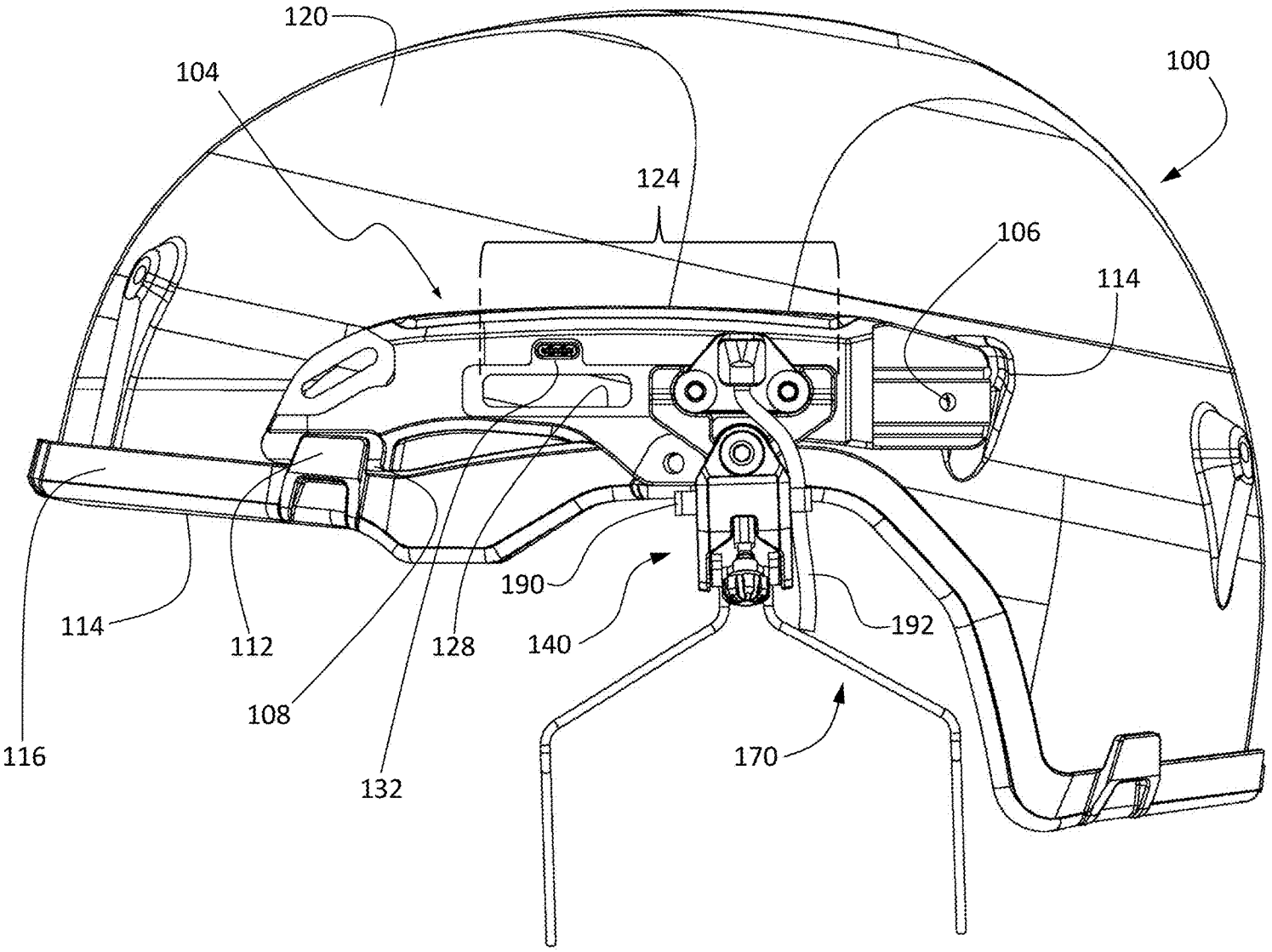
FIG. 1 is a side view of a helmet employing an exemplary embodiment helmet mounted accessory rail with an exemplary attached accessory.
Figure 2:
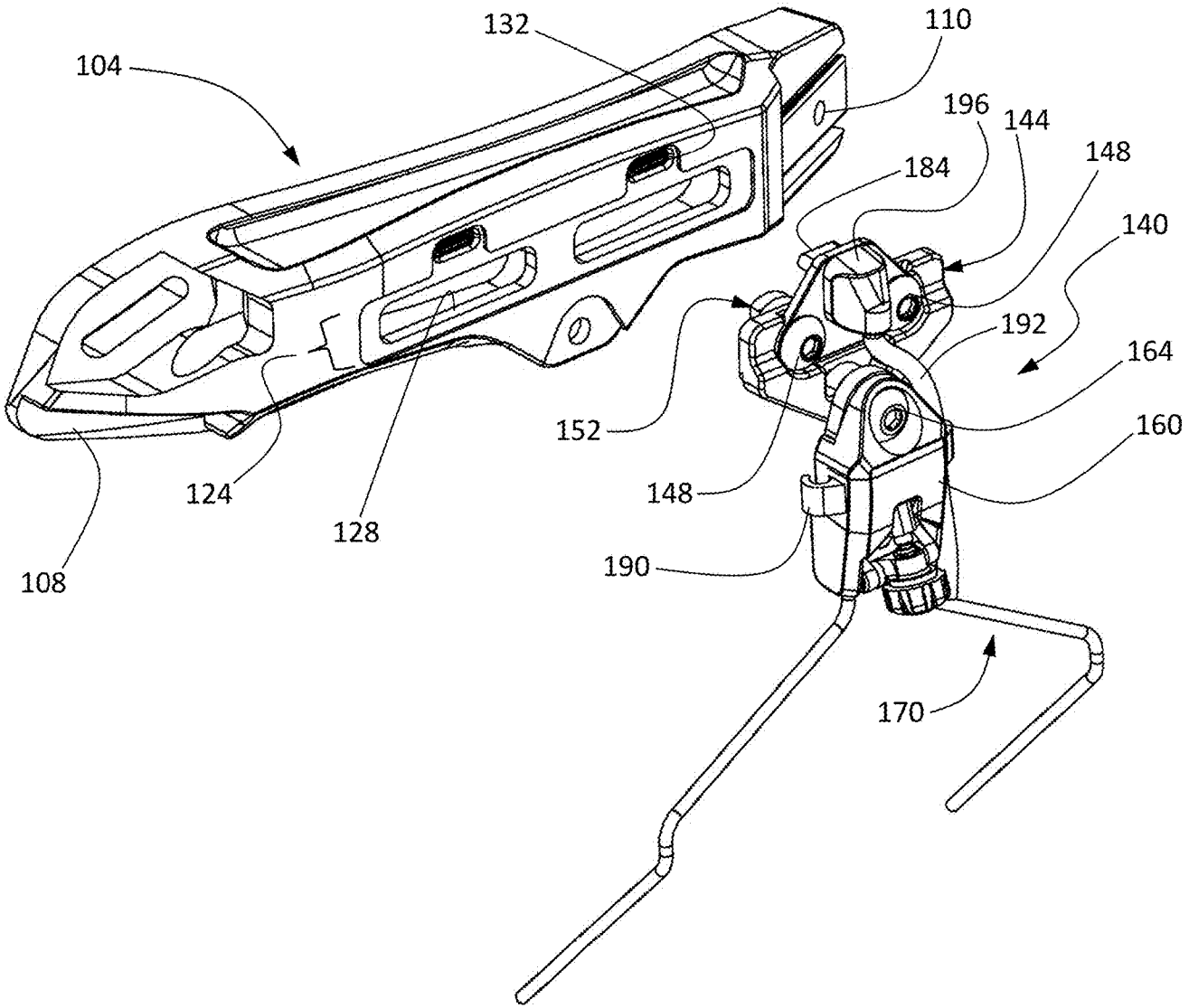
FIG. 2 is a partially exploded isometric view of the helmet mounted accessory rail and accessory appearing in FIG. 1.
Figure 3:
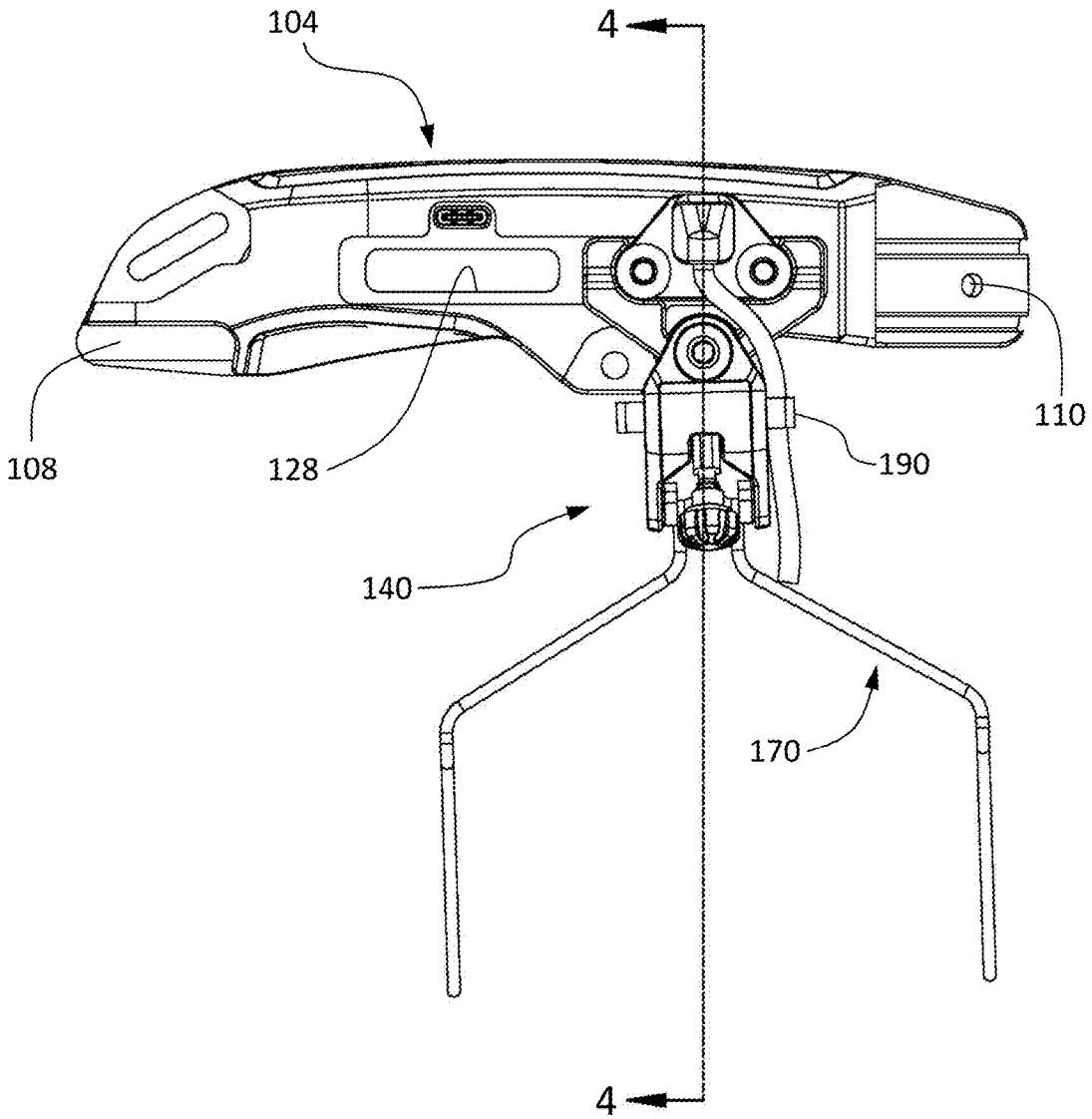
FIG. 3 is a side view of the helmet mounted accessory rail with attached accessory appearing in FIG. 1.
Figure 4:
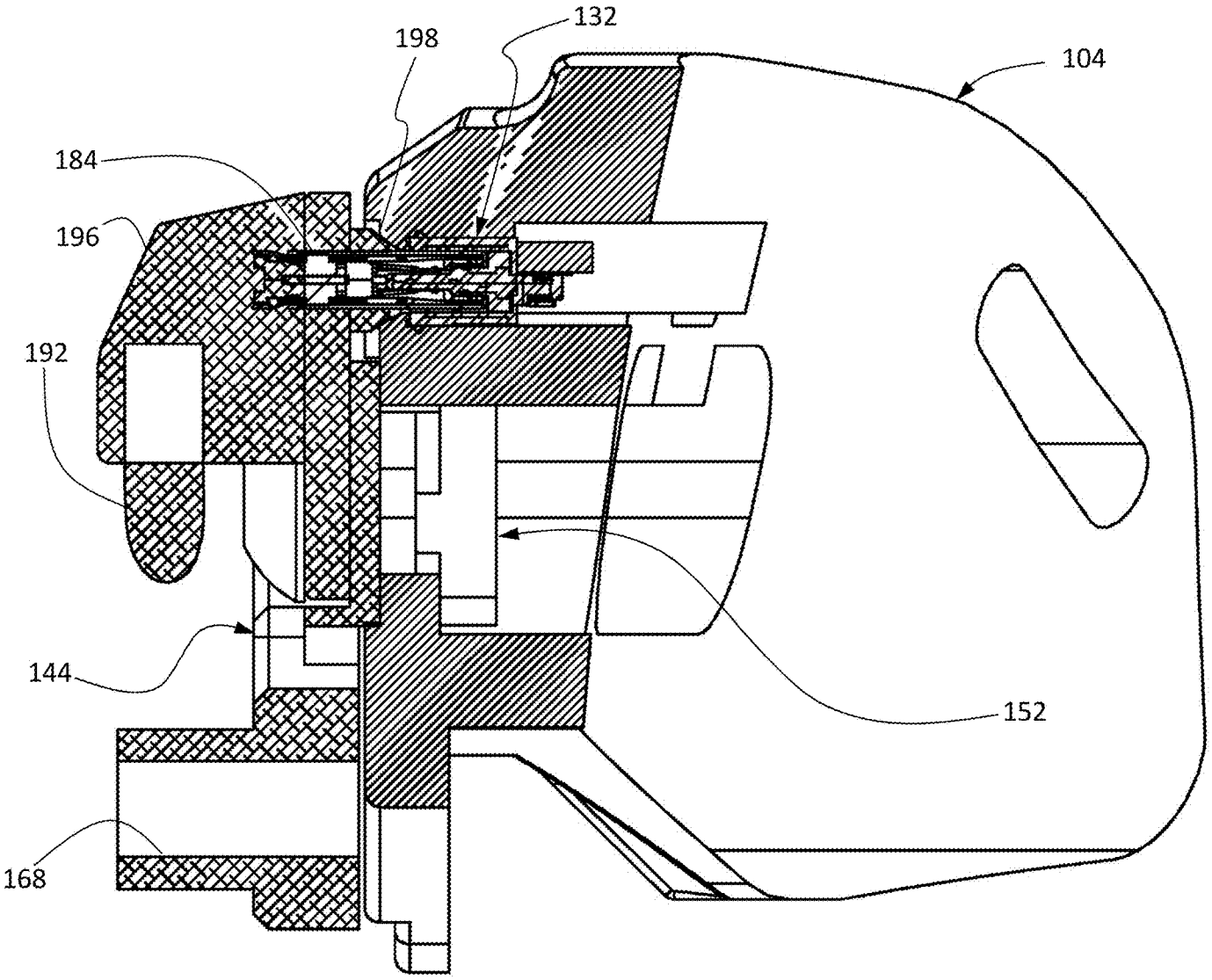
FIG. 4 is a cross-sectional view of the helmet mounted accessory rail and accessory taken along the lines 4-4 appearing in FIG. 3.
Figure 5:
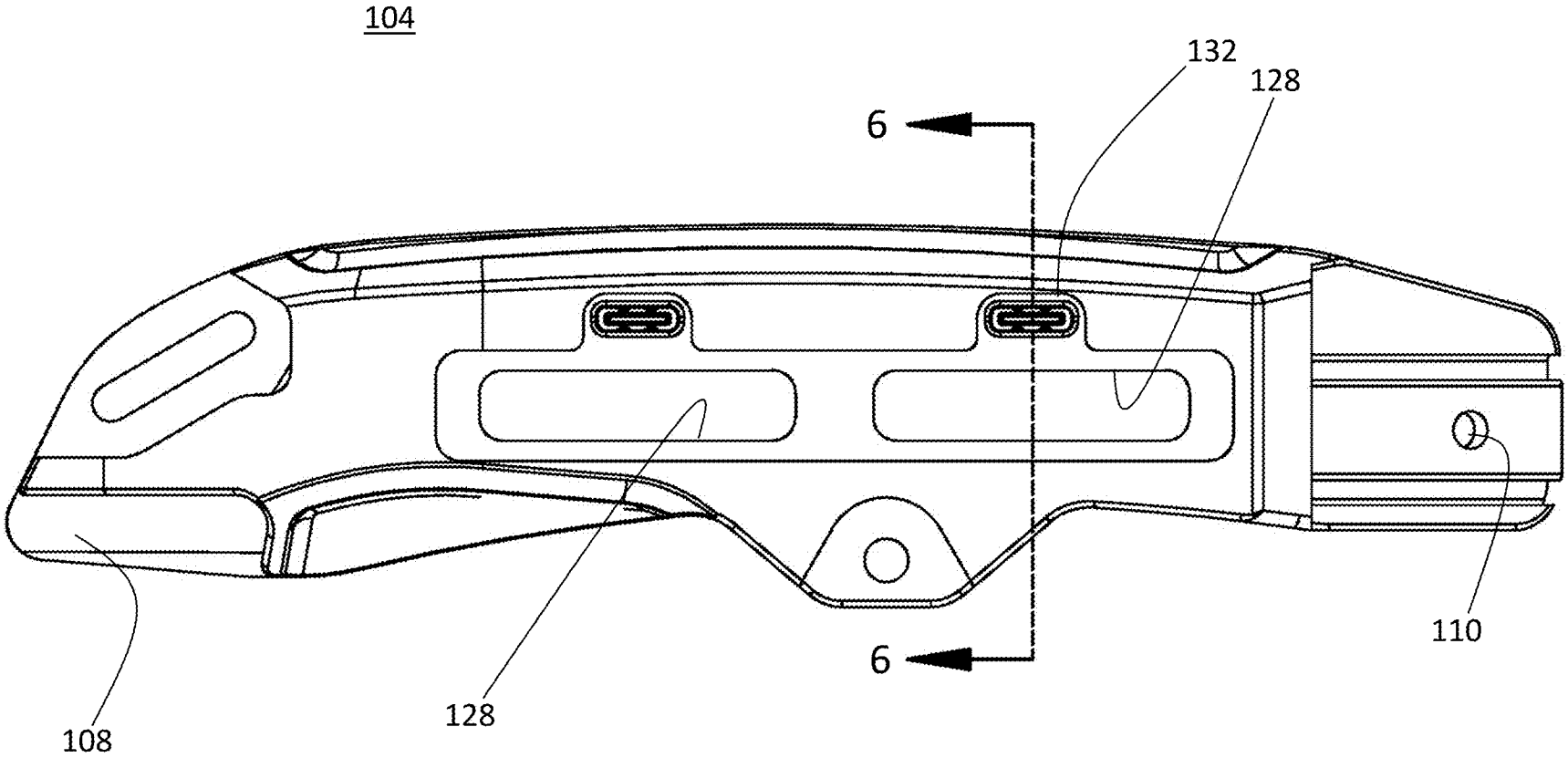
FIG. 5 is a side view of the helmet mounted accessory rail appearing in FIG. 1.
Figure 6:
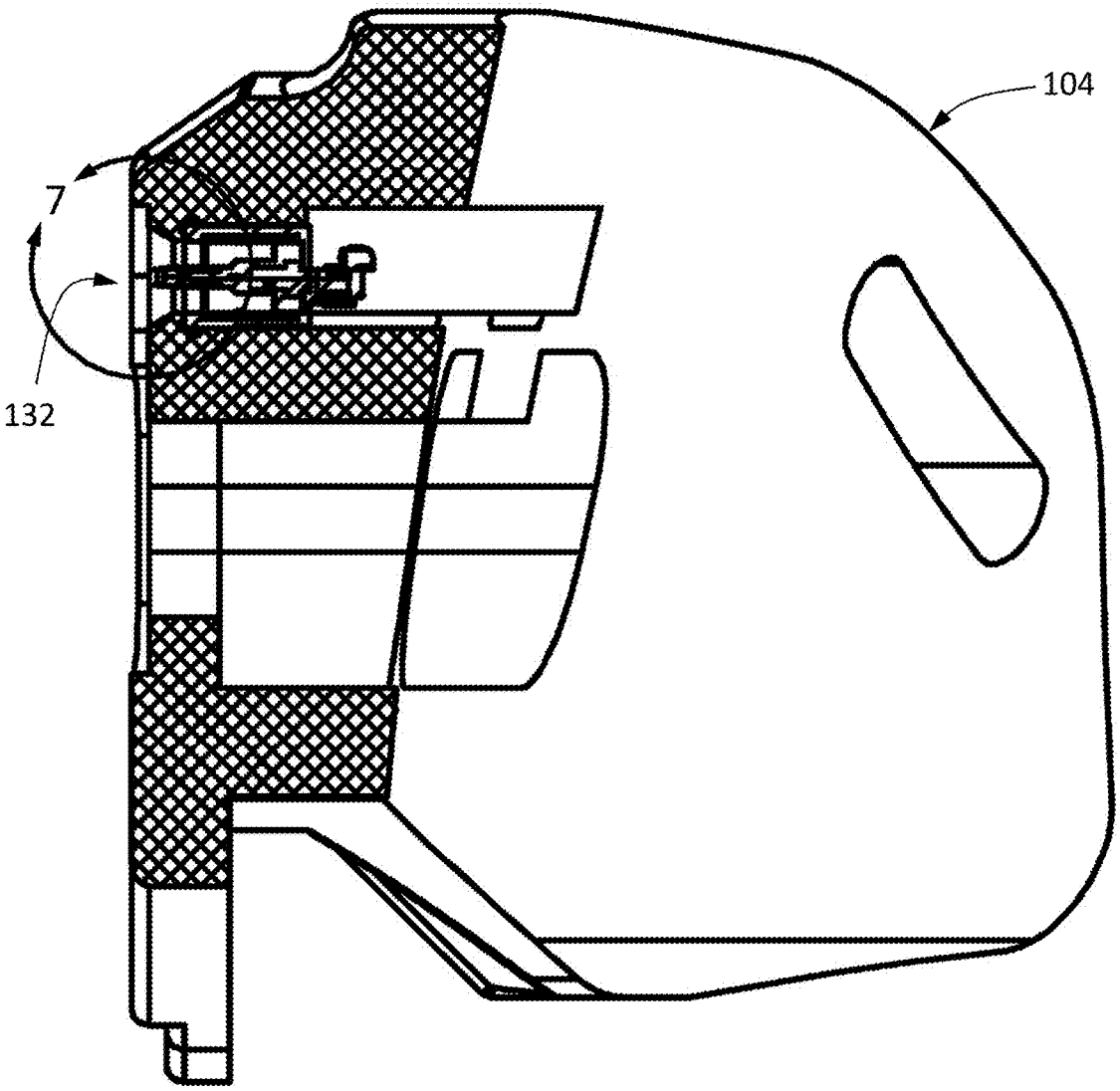
FIG. 6 is a cross-sectional view of the helmet mounted accessory rail taken along the lines 6-6 appearing in FIG. 5.
Figure 7:
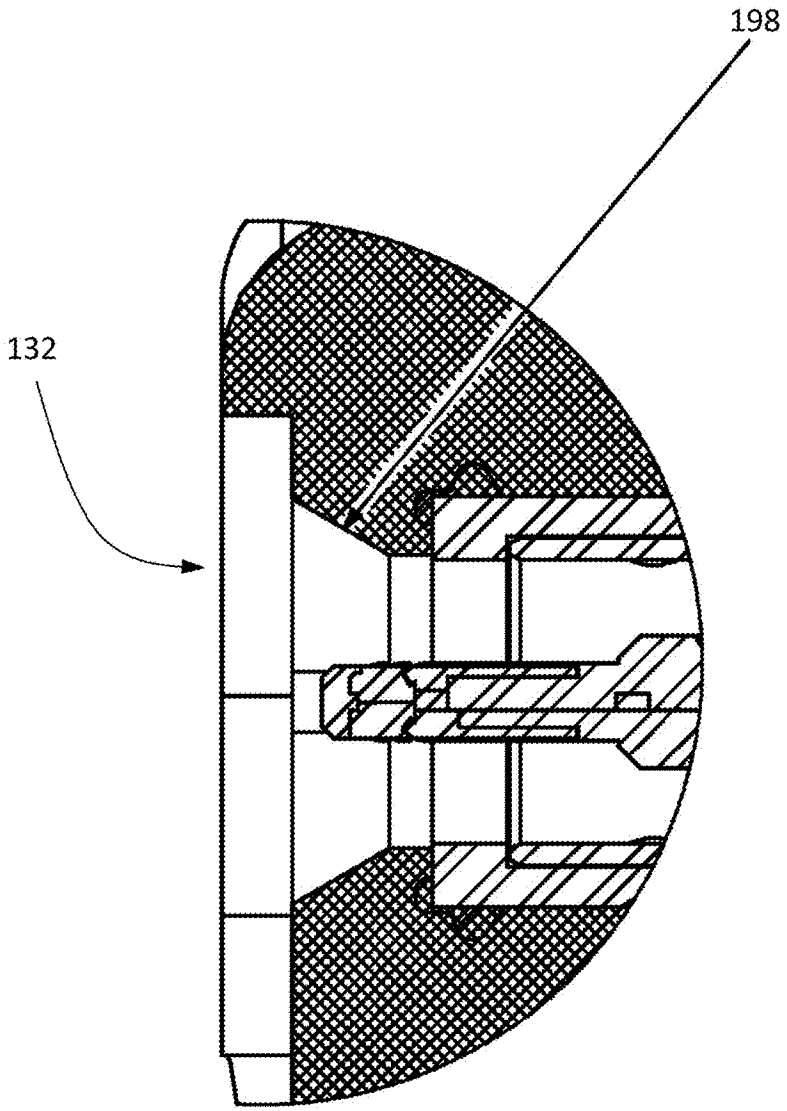
FIG. 7 is an enlarged view of the region 7 appearing in FIG. 6.
Figure 8:
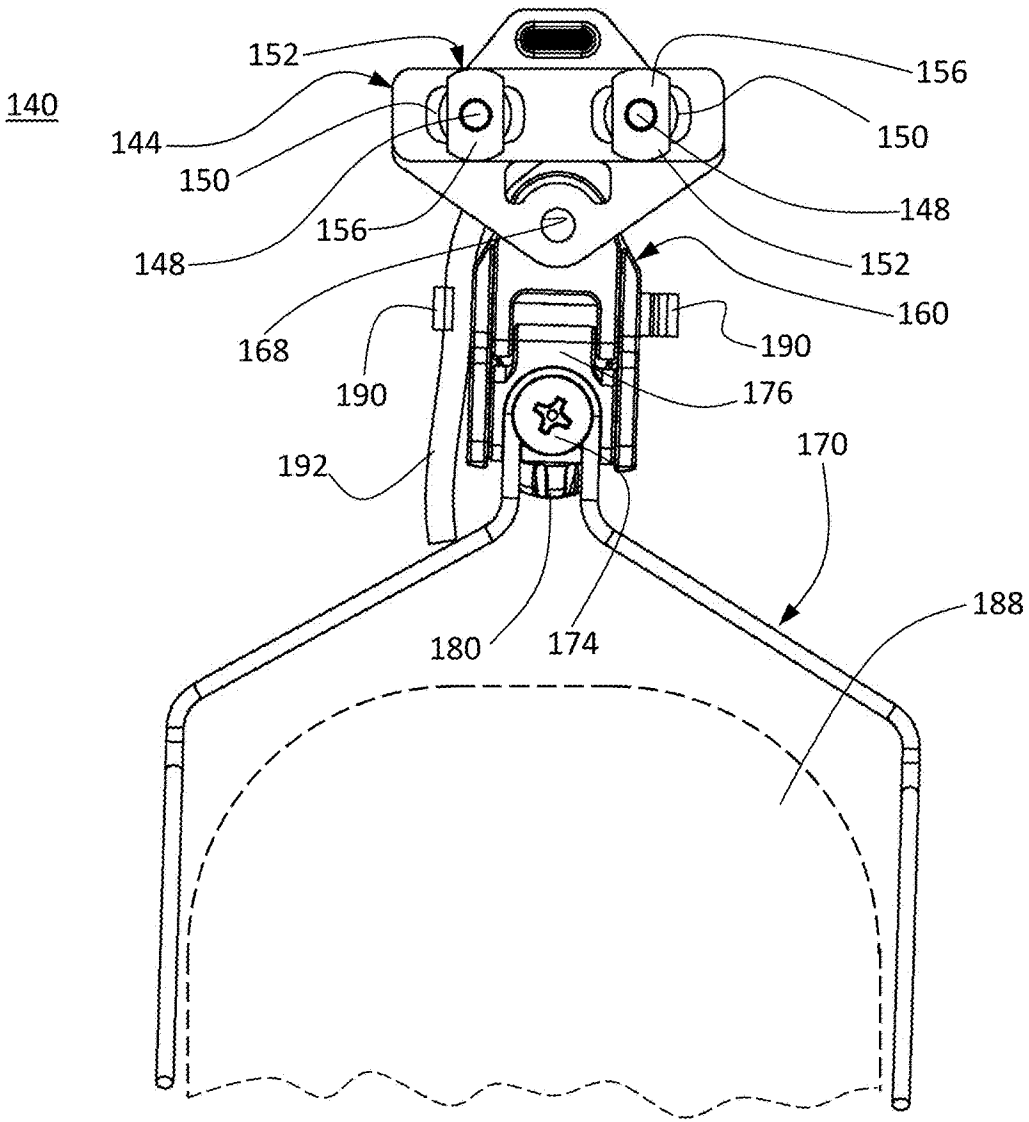
FIG. 8 is an enlarged right side view of the accessory device appearing in FIG. 1.

Reference will now be made in detail to presently preferred embodiments of the invention, one or more examples of which are illustrated in the accompanying drawings. Each example is provided by way of explanation of the invention, not limitation of the invention, which may be embodied in various forms. Therefore, specific structural and functional details disclosed herein are not to be interpreted as limiting but merely as a basis for the claims and as a representative basis for teaching one skilled in the art to variously employ the present inventive concept in virtually any appropriately detailed structure. Further, the terms and phrases used herein are not intended to be limiting but rather to provide an understandable description of the present development. In fact, it will be apparent to those skilled in the art that modifications and variations can be made in the present invention without departing from the scope or spirit thereof. For instance, features illustrated or described as part of one embodiment may be used in another embodiment to yield a still further embodiment. Thus, it is intended that the present invention covers such modifications and variations as come within the scope of the appended claims and their equivalents.

The terms "a" or "an," as used herein, are defined as one or more than one. The term "another," as used herein, is defined as at least a second or more. The terms "including" and/or "having" as used herein, are defined as comprising (i.e., open transition). The term "coupled" or "operatively coupled," as used herein, is defined as indirectly or directly connected.

As used in this application, the terms "front," "rear," "upper," "lower," "upwardly," "downwardly," "left," "right," and other orientation descriptors are intended to facilitate the description of the exemplary embodiment(s) of the present invention and are not intended to limit the structure thereof to any particular position or orientation.

All numbers herein are assumed to be modified by the term "about," unless stated otherwise. The recitation of numerical ranges by endpoints includes all numbers subsumed within that range (e.g., 1 to 5 includes 1, 1.5, 2, 2.75, 3, 3.80, 4, and 5).

Referring now to the drawing FIGS. 1-11, FIG. 1 is a left side view of a helmet 100 having a side mounted accessory rail or shroud 104. In the illustrated embodiment, a left side shroud 104 is illustrated. It will be recognized that the left side shroud is a mirror image thereof. The rail 104 includes a blade, tab, tongue, or the like 108 for releasable retention within a clip or catch 112 disposed on a brim 114 of the helmet 100. In embodiments, the helmet brim 114 is defined by a separately formed edge trim piece 116 that is separately formed and attached to an edge (e.g., an unfinished edge) of a shell portion 120 of the helmet 100. Alternately, the edge trim 116 may be integrally or monolithically formed with the shell portion 120. The rear portion of the rail 104 is attached via a threaded fastener 106 passing through a clearance opening 110 in the rail which engages a tapped opening in a boss 114 disposed on the shell. In embodiments, a rail portion 105 is provided to allow attaching one or more additional helmet rail interface components 111, 113 (see FIG. 11).

The rail 104 defines a slot rail interface portion 124 comprising a plurality of elongate slots 128. Each slot 128 has a peripheral inward flange 130 having a thickness and extending between the first or outer surface of the slot rail interface portion 124 and the second or rear surface of the slot rail interface portion 124. Each slot 128 has an associated power/data interface port or receptacle 132 for routing any one or more of power, data, and control signal between an attached accessory device and the helmet. In embodiments, the power/data port 132 is a USB type C (USB-C) port configured to allow insertion of a USB-C plug for data transfer, charging, or other functionalities. In embodiments, the slots 128 may comprise a Modular Lock or M-LOK™ (Magpul Industries Corp., Austin, TX) compatible mounting interface slots, or slots compatible with similar systems.

An accessory device 140 is detachably connected to the rail 104. In the illustrated embodiment, the accessory device 140 is a circumaural device, such as headphones, a communications headset or earpiece, hearing protection device, or the like. It will be recognized that other types of accessory devices are also contemplated, such as flashlights or tactical lights, cameras, or video recording devices.

The accessory device 140 includes a base 144 having a long axis which extends parallel to the long axis of the corresponding elongate slot 128. A pair of spaced apart threaded fasteners 148 are provided. Each threaded fastener 148 passes through a clearance opening 150 in the base 144 and engages a rotatable retention clip 152. Each retention clip 152 includes opposing extending tab portions 156 which cooperate to form a crossbar defining a T-shape, wherein the tabs 156 form the arms of the "T." Rotation of the fastener 148 allows for selectively tightening/clamping and loosening/unclamping the base 144 to the slot 128.

In embodiments, the corners of the tab portions 156 of the retention clips 152 can be selectively radiused or rounded to permit the clips 152 to rotate when the threaded fasteners 148 are rotated and selectively squared to act as stops to prevent rotation of the clips 152 when the threaded fasteners 148 are rotated, i.e., depending on the direction of rotation and current position of the clips 152. Alternately, in certain embodiments, stop members may be provided within the interior of the rail 104 adjacent to the slots 128 to limit rotation of the retention clips 152.

To secure the base 144 to the slot 128, both retention clips 152 are rotated so that the tabs portions 156 are aligned with the long axis of the slot 128 to allow the tabs portions 156 to pass through the slot 128. Thereafter, the fasteners 148 are tightened, which causes the retention clips 152 to rotate 90 degrees until the long axis of the tabs 156 is perpendicular to the long axis of the slot 128 thereby securing the base 144 to the rail 104. The facing surface of the base 144 and the tabs 156 define a channel which can be adjusted using the threaded fastener 148 to accommodate the thickness of the inward flange 130 to provide clamping engagement of the inward flange 130 when the tabs 156 are rotated to the locked position.

The accessory device 140 further includes a bracket 160. A threaded fastener 164 passes through a clearance opening (not shown) in the bracket 160 and threadably engages a tapped opening 168 in the base 144. A wire yoke 170 is secured to the bracket 160 with a threaded fastener 174. The wire yoke 170 includes a pair of spaced apart wire legs 172 to which a communication headset or headphone car cup 188 (see FIG. 8) of the circumaural device may attached.

Figure 9:
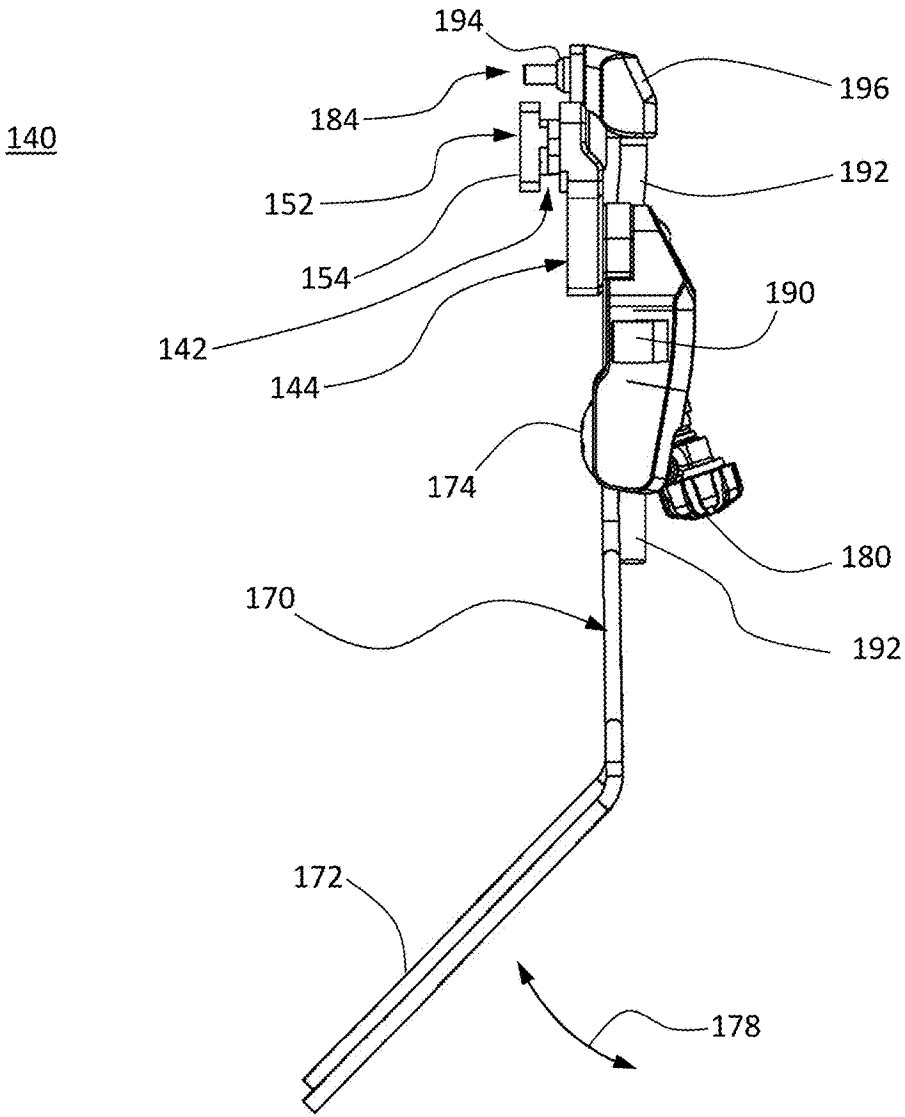
FIG. 9 is an enlarged front view of the accessory device appearing in FIG. 1.
Figure 10:
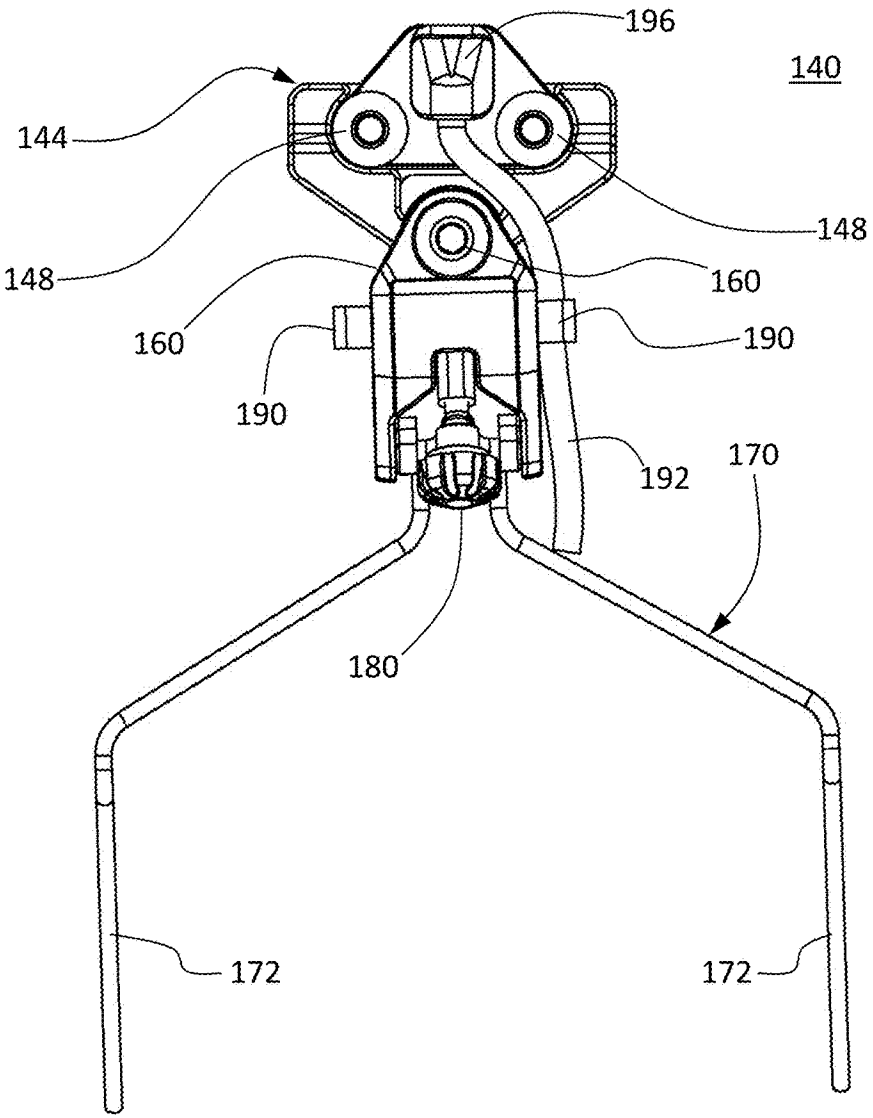
FIG. 10 is an enlarged left side view of the accessory device appearing in FIG. 1.

In embodiments, the wire yoke 170 is attached to a bracket pivot member 176 that is pivotable in relation to the main bracket housing to the allow the yoke 170 to be pivoted toward and away from the user's head as indicated by the arrow 178 in FIG. 9. An adjustment screw 180 on the bracket 160 bears against the bracket pivot member 176 and can be advanced or retracted to allow fine tuning of the pressure of the car cup 188 against the user's head.

In the illustrated embodiment, the base 144 includes an electrical connector 184, which is a USB type-C (USB-C) plug in the illustrated embodiment The connector 184 is aligned with the connector 132 on the rail 104. In embodiments, the connectors 132, 184 are weatherized via the interfacing geometry. In embodiments, one or more scaling rings may be provided. The connector 132, in turn, is operably coupled to one or more other accessory devices (not shown), such as computer-based system or controller, power supply, communication system, and so forth. In embodiments, the connector 132 is a USB-C socket which includes an angled sealing surface 198 which engages a complementary facing angled sealing surface 194 on the plug 184. In embodiments, one or both of the sealing surfaces may be formed of an elastomeric material. In embodiments, one or both of the sealing surfaces may be formed of a thermoplastic material.

A multi-conductor cable 192 (shown in fragmentary view for illustration purposes) passes through a connector housing portion 196 on the base 144. In embodiments, the cable 192 is retained with a cable retention clip 190. In embodiments, the multi-conductor cable 192 passes audio information between an attached car cup 188 and a communications system or a computer-based information handling system, such as a helmet communications system or a helmet computer or controller. In embodiments, audio information is transmitted in one direction or in both directions. For example, in embodiments, an audio signal can be sent from a communications system or a computer-based information handling system operatively coupled to the helmet 100 to an earphone 188 on the accessory device 140. In embodiments, an audio signal can be sent from a microphone associated with the earphone 188 on the accessory device 140 (such as a microphone attached to a boom attached to the headset 188) to a communications system or a computer-based information handling system. In embodiments, the audio information is transmitted as an analog signal wherein the plug 184 and socket 132 act as a pass through for the analog audio signals. Alternatively, the audio information is transmitted as a digital audio signal whereupon it is decoded by digital-to-analog conversion (DAC) circuitry in the receiving device.

Figure 11:
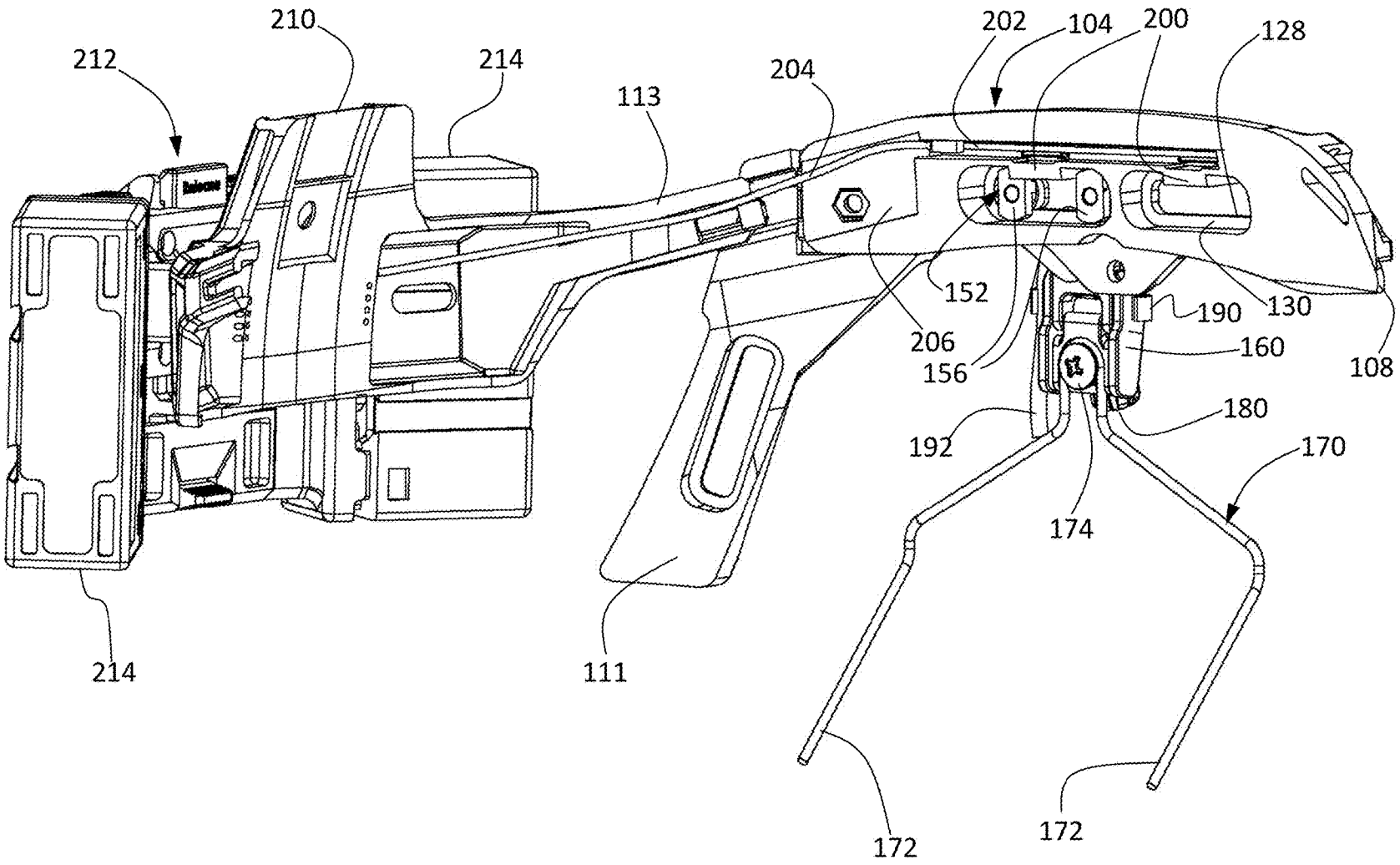
FIG. 11 is a rear isometric view of the helmet mounted accessory rail herein taken generally from the helmet facing side and being coupled to a rear bridge module/battery adapter.

As best seen in FIG. 11, each receptacle 132 includes a rear housing 200 supporting conductors or pins which are coupled to a printed circuit board 202. A multiconductor cable 204 is electrically coupled to the circuit board 202. The multiconductor cable 204 may be a multicore cable, ribbon cable, flexible flat cable, or the like. The cable 204 is run within a channel or cavity 206 formed in the inward facing side of the rail shroud 104 to one or more additional interface components. In the illustrated embodiments, the conductors within the cable 204 are in electrical communication with respective conductors on a rear shroud or bracket 210. In embodiments, the cable 204 terminates in a USB-C connector which connects to a complementary USB-C connector (not shown) on the battery adapter/bridge 212.

The rear shroud 210, in turn, is configured to mechanically and electrically attach to a battery adapter 212. The battery adapter 212 detachably receives one or more battery packs 214 for providing electrical power for one or more attached accessory devices and provides a bridge for coupling left and right side shrouds to the power, data, and control signals circuitry. In embodiments, the battery adapter or bridge may be as described in commonly owned U.S. provisional application No. 63/427,496 filed Nov. 23, 2022; U.S. application Ser. No. 18/500,657 filed Nov. 2, 2023; U.S. provisional application No. 63/433,661 filed Dec. 19, 2022; U.S. application Ser. No. 18/544,128 filed Dec. 18, 2023; 63/454,691 filed Mar. 26, 2023; U.S. application Ser. No. 18/614,070 filed Mar. 22, 2024; 63/461,538 filed Apr. 24, 2003; U.S. application Ser. No. 18/636,599 filed Apr. 16, 2024; 63/464,738 filed May 8, 2023; and U.S. application Ser. No. 18/651,188 filed Apr. 30, 2024. Each of the aforementioned applications is incorporated here by reference in its entirety.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

What is claimed is:

1. A rail interface system for connecting a helmet accessory component to a helmet, the rail interface system comprising:

an interface body configured for attachment to an exterior surface of a helmet, the interface body configured for attachment of the helmet accessory component thereto;

a slotted interface portion on the interface body, the slotted interface portion having a first surface and a second surface opposite the first surface;

at least one elongated rail opening extending through the slotted interface portion;

the at least one elongated rail opening configured to receive a retention clip on the helmet accessory device for detachably securing the helmet accessory device to the rail interface system;

at least one electrical connector positioned adjacent a respective one of the at least one elongated rail opening, the at least one electrical connector operational to provide one or both of electrical power and data communication to the helmet accessory component when the helmet accessory component is attached to the rail interface system;

said at least one elongated rail opening bounded by an inward flange;

said at least one elongated rail opening configured to receive the retention clip, wherein the retention clip is a rotatable, generally T-shaped retention clip configured to pass through the at least one elongated rail opening when the generally T-shaped retention clip is rotated to an unlocked orientation parallel to a longitudinal axis of the at least one elongated rail opening; and said at least one elongated rail opening configured for clamping engagement of the inward flange when the generally T-shaped retention clip is rotated to a locked orientation perpendicular to the longitudinal axis of the at least one elongated rail opening.

2. The rail interface system of claim 1, wherein the at least one elongated rail opening conforms to an M-LOK™ rail standard.

3. The rail interface system of claim 1, wherein the slotted interface portion includes a plurality of elongated rail openings and a plurality of electrical connectors.

4. The rail interface system of claim 1, wherein the at least one electrical connector is a USB-C receptacle connector which is arranged to align with a USB-C plug on the helmet accessory component.

5. The rail interface system of claim 1, in combination with the helmet accessory component.

6. The rail interface system of claim 5, wherein the helmet accessory component is selected from the group consisting of circumaural devices, headphones, communications headsets, hearing protection devices, flashlights, tactical lights, cameras, and video recording devices.

7. The rail interface system of claim 1, wherein the at least one electrical connector is operably coupled to a circuit board disposed within the interface body.

8. The rail interface system of claim 7, further comprising a multiconductor cable electrically coupled to the circuit board, the multiconductor cable disposed on an inward facing side of the interface body.

9. The rail interface system of claim 8, wherein the multiconductor cable is configured to electrically couple the helmet accessory component to an external power source.

10. The rail interface system of claim 9, further comprising a battery adapter, the battery adapter configured to detachably receive and electrically couple to one or more battery packs.

* * * * *